United States Patent [19]

Heurich

[11] 4,009,658

[45] Mar. 1, 1977

[54] FLUID METERING ROLL AND METHOD OF MAKING THE SAME

[75] Inventor: Charles R. Heurich, Hanover, N.J.

[73] Assignee: Pamarco Incorporated, Roselle, N.J.

[22] Filed: Apr. 26, 1974

[21] Appl. No.: 464,692

[52] U.S. Cl. ..... 101/348; 101/350; 427/423; 29/132

[51] Int. Cl.[2] ..... B41F 31/26

[58] Field of Search ..... 101/348, 350, 363; 117/46 FS, 94, 105.2; 29/121 R, 132

[56] References Cited

UNITED STATES PATENTS

| | | | |
|---|---|---|---|
| 2,213,419 | 9/1940 | Taylor | 101/350 |
| 2,614,492 | 10/1952 | Brodie | 101/350 |
| 2,974,388 | 3/1961 | Ault | 25/156 |
| 3,048,061 | 8/1962 | Mele | 117/105.2 |
| 3,285,169 | 11/1966 | Hartwig | 101/350 |
| 3,310,423 | 3/1967 | Ingham, Jr. | 117/105.2 X |
| 3,364,545 | 1/1968 | O'Neal et al. | 117/94 X |
| 3,378,392 | 4/1968 | Longo | 117/105.2 X |
| 3,613,578 | 10/1971 | Heurich | 101/350 |

FOREIGN PATENTS OR APPLICATIONS

| | | | |
|---|---|---|---|
| 1,261,787 | 2/1968 | Germany | |
| 729,561 | 5/1953 | United Kingdom | 101/348 |
| 928,383 | 12/1961 | United Kingdom | 101/350 |

OTHER PUBLICATIONS

"The Metco Flame Spraying Process", Bulletin 136B 1960, Metallizing Engineering Co., Inc. Westbury, L. I., N. Y.

"Revolution in Rollers", *Box Board Containers* Oct. 1973, pp. 27–35.

"Flame-Sprayed Coatings", *Product Engineering* vol. 36, No. 25, Dec. 6, 1965, pp. 59–64.

*Primary Examiner*—J. Reed Fisher

*Attorney, Agent, or Firm*—Mark T. Basseches; Paula T. Basseches

[57] ABSTRACT

The present invention is directed to a novel metering roll for inks or the like and to the method of making the same. In accordance with the invention, a cylindrical metallic roller core is provided with a multiplicity of shaped indentations or receiver cells in its periphery, in concentration of from about 35 to 90 cells per lineal inch in each direction, the cells being preferably generally in the form of inverted pyramids of a selected volumetric capacity, the receiver cells being preferably closely spaced and separated by land areas of minimal size of the order of 30 microns or less. A ceramic coating is applied over the surface of the roller by a plasma flame technique which is known per se, in such manner that the periphery and the walls of the cells are covered to define an extremely wear resistant, long lived protective surface, the coating partially filling the receiver cells and providing a ceramic surface having outwardly open metering cells, the volumetric capacity of the metering cells being substantially less than that of the receiver cells, i.e. in the order of one fifth of the volume or less.

7 Claims, 4 Drawing Figures

FLUID METERING ROLL AND METHOD OF MAKING THE SAME

BACKGROUND OF THE INVENTION

1. Field of the Invention

The present invention is in the field of metering rolls and more particularly rolls for metering ink or like fluids, such rolls being commonly referred to as anilox rolls.

2. The Prior Art

It is known to provide an ink metering or anilox roll comprising a cylindrical core having formed in the periphery thereof a multiplicity of spaced ink-capturing cells. When used in an anilox process, the roller functions to pick up ink from an ink source and to deposit on a subsequent printing roller or the like, discrete, separated areas of ink, the quantity deposited being desirably controlled within close tolerances as a result of the size, configuration and spacing of the cells. An example of an advanced form of anilox or ink metering roll is disclosed in U.S. Pat. No. 3,613,578, wherein the cells formed in the surface of the roll are especially configurated to achieve ink transfer in a precise manner, as more fully set forth in said patent.

It will be readily recognized that the formation of anilox rolls having high concentrations per lineal inch of precisely shaped ink metering cells is a costly procedure, which cost is nonetheless justified due to the improved quality of printing resulting from the use of the rollers. Such rollers typically are comprised of metallic materials plated to permit the same to resist the corrosive influences of the inks employed, and are subject to relatively rapid wear, requiring their frequent replacement. Once again, the cost inhering in replacement due to wear is justified by the quality of resultant printing.

In areas where high quality printing is not mandatory, such as the imprinting of paper bags, corrugated boxes or the like, it is nonetheless highly desirable that precise quantities of ink be metered onto the printing apparatus by the anilox roll.

While it is theoretically possible to utilize anilox rollers, such as described in the above noted patent, for non-critical applications, such as bag imprinting, etc. and achieve the desired precise metering effects, the high wear factor and consequent high cost of roller replacement do not, as a practical matter, justify their use.

Attempts have recently been made to provide a durable ink transfer roll for non-critical printing applications, the roll comprising a cylindrical metal core covering with ceramic material. While such coated rollers possess the necessary durability, they are incapable of metering quantities of fluid to the printing apparatus with the degree of repeatability and precision desired even in such rough printing applications as bag printing, etc.

SUMMARY

The present invention may be summarized as directed to an improved metering roller having long life characteristics and capable of transferring on a repeatable basis, precisely controlled quantities of ink from an inking roller or the like to a printing roller or the like.

While the roller of the invention will be described herein principally in connection with the dispensing of ink in a printing procedure, it is within the contemplation of the present invention to utilize the same in any situation where durability, protection from corrosion, and transfer of accurate quantities of a liquid are desired, e.g. adhesive applicators, etc.

In accordance with the invention, a cylindrical core, normally of metal, is engraved or otherwise provided with a multiplicity of depressions or receiver cells of configuration and concentration characteristics more clearly set forth hereinafter. The engraved core is thereafter subjected to a plasma flame deposit procedure which forms an extremely hard ceramic coating on the exposed surfaces of the core, including the periphery and the cell surfaces, the term "ceramic coating" being used in the special sense herein as relating to a coating formed by plasma flame techniques.

It has been determined that where the concentration of cells and the configuration of the cells, and particularly the angular relationship of the cell defining walls to the surface of the roller, are maintained within certain critical limits, there is provided by the above described procedure an extremely durable, long lasting, corrosion resistant anilox roller characterized by liquid transfer properties superior in predictability to rollers heretofore commercially available, even rollers of the engraved metal plated types mentioned above.

More particularly, it has been determined that where a plasma flame applied ceramic coating is formed on the surface of a metal cylinder core provided with receiver cells in concentration of from about 35 to 90 cells per lineal inch in each direction, the cells being generally in the form of inverted pyramids, the angle of inclusion of the pyramic walls to the surface being maintained at a value of about 36° or less and the receiver cells being closely spaced by about 30 microns or less, there is provided an extremely durable transfer roller capable of applying to a printing roller or the like a quantity of ink during each cycle with a degree of predictability not encountered with any prior known rollers, including the plated anilox rollers previously mentioned.

While the resultant roller is not subject to use in situations where precise gradations of tonal density values are encountered, such procedures mandating the use of far higher cell concentrations than above set forth, the roller of the instant invention has characteristics rendering the same particularly useful in so-called rough printing and similar operations which require accurately determined quantities of ink to be applied but wherein the quantities need not be isolated into minutely spaced separate areas.

It is accordingly an object of the invention to provide an improved fluid metering roller.

A further object of the invention is the provision of a metering roller having a surface ceramic coating of extreme hardness and, hence, durability, which coating defines radially outwardly open cells in a desired volumetric range, the cell concentration being from about 35 to 90 cells per lineal inch in each direction.

It is still a further object of the invention to provide a metering roller of the type described, further characterized in that the cell configurations are in the form of generally inverted pyramids, the bases of the pyramids being coincident with the periphery of the finished roller, the walls of the pyramids in the core being related to the roller surface at an angle of 36° or less.

It is still a further object of the invention to provide a novel method of forming a metering roller as set forth above, which entails forming, by engraving or otherwise, in a metal cylindrical core a multiplicity of cells of a first configuration and volume, and forming on said engraved core by a flame deposit method, a ceramic coating which significantly reduces the volume of the cells and to a degree changes their configuration.

To attain these objects and such further objects as may appear herein or be hereinafter pointed out, reference is made to the accompanying drawings, forming a part hereof, in which.

The term "ceramic coating" as used herein is intended to relate to a coating formed by a plasma flame process known per se. In accordance with the process, a dispensing head comprising a nozzle having a dispensing aperture or apertures has conducted thereto gaseous fuels and oxidizers, typically hydrogen and oxygen or compressed air, the combustion of these gases producing within a chamber in the nozzle an extremely high temperature, in the order of from 18000° to 30000° F.

Finely subdivided particles of metallic oxide, typically aluminum oxide ($Al_2O_3$), with or without additive quantities of titanium oxide, are introduced into the combustion zone, the said particles being widely separated and preferably entrained within one or more of the gaseous components leading to the nozzle.

As a result of the extreme heat of combustion, the particles are melted, the expansion forces generated propelling the melted particles away from the nozzle at extremely high speeds, in the order of Mach 1 to Mach 2. The substantial momentum of the molten particles permits the nozzle to be spaced sufficiently far from the roller core to allow the still molten material to coat the core without the flame damaging the core.

Figure 1:
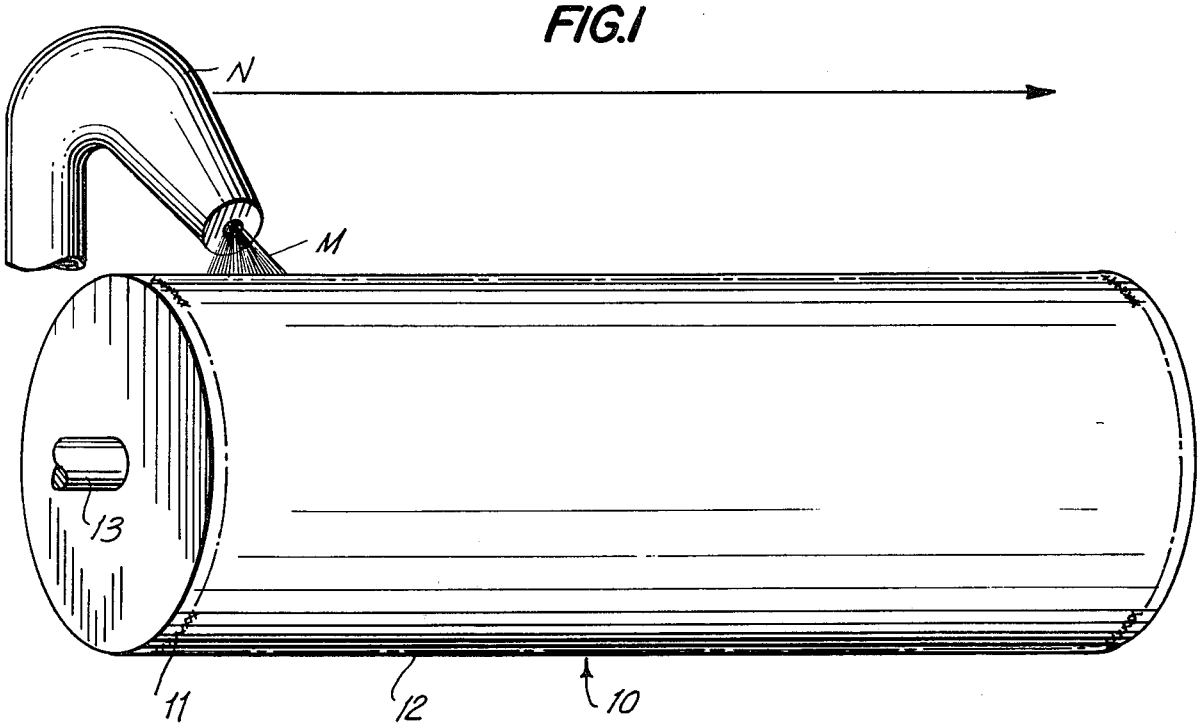
FIG. 1 is a perspective view of an engraved roller core being treated to form a ceramic coating on the surface thereof.
Figure 3:
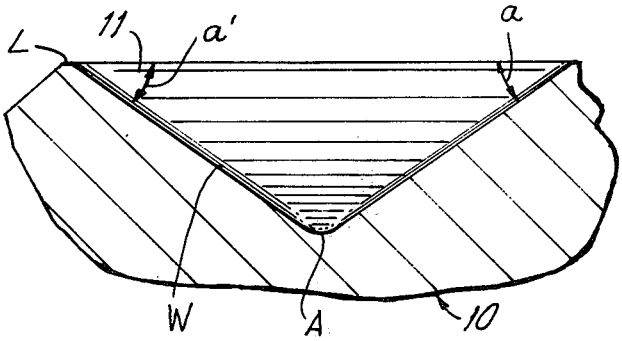
FIG. 3 is a section taken on the line 3—3 of FIG. 2.
Figure 2:
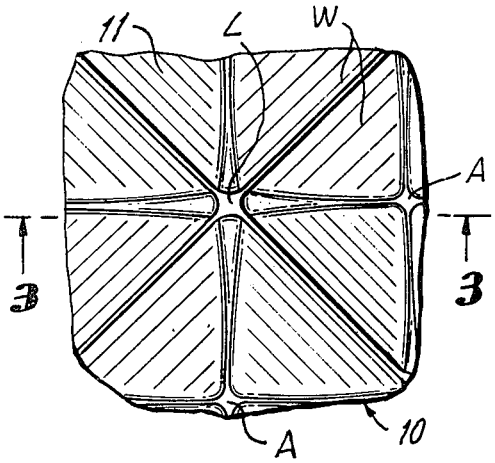
FIG. 2 is a greatly magnified plan view of a series of engraved receiver cells formed in the core.

As best appreciated from FIGS. 2 and 3, the individual receiver cells 11 are generally in the form of inverted pyramids, the base portions of which coincide with the surface 12 of the roller 10. The inclined side walls W defining the walls of the pyramids meet at apices A which are preferably somewhat rounded. Additionally, the intersections I defining the junctions between adjacent walls W are rounded to provide a smooth and gradual connection between adjacent walls W.

It is an important feature of the present invention that the included angles, viz. *a* and *a'* (FIG. 3) between each of the walls W of the cells 11 and the surface of the periphery 12 of the roller 10 not exceed about 36°. The cells are separated by lands L of minimal extent, preferably 30 microns or less and desirably in the order of about 15 microns.

The cells 11 engraved in the core are regularly spaced apart and are of such concentration that there exist about from 35 to 90 cells per lineal inch in any direction.

The ceramic coating is formed over the surface of the roller and the exposed surfaces of the cells by slowly rotating the roller 10 about its axis shaft 13 while the nozzle N, dispensing the molten particles, is directed toward the surface of the roller. The axis of the cone of material M dispensed by the nozzle is directed precisely normal to the central axis of rotation of the roller.

The nozzle N is moved progressively lengthwisely relative to the rotating roller until a ceramic coating of sufficient thickness is built up on the surface of the roller, a thickness of from about 0.002 inch to 0.008 inch being desirable. The thickness of the coating within the cells will vary substantially in accordance with its position, a substantially greater build-up being observed in registry with the apex A than over the walls W. As a result, the volumetric capacity of the coated cells, referred to as metering cells, is substantially reduced despite the fact that the build-up in registry with the periphery of the roller tends to increase the capacity of the cells.

The volume of the metering cells is desirably in the range of about one fifth to one twentieth of the volume of the receiver cells.

As will be understood by those skilled in the art of forming of ceramic coatings by the plasma flame process above described, the characteristics and texture of the coating and the nature of its bond to the substrate may be varied by altering any of a number of parameters — by way of example, the volume per time element at which the fuel, oxidant and particulate material are supplied; the spacing of the nozzle from the substrate; the speed of rotation of the substrate; the rapidity with which the nozzle is moved axially along the substrate; the speed with which the molten particulate material is discharged to the roll; dispersion characteristics of the nozzle; the internal temperature in the nozzle or gun; the composition of the particulate compound; the composition and construction of the roll itself, and the kind and configuration of the engraving, etc. Thus, an initial trial and error period to assure optimum coating for a particular application of the roller must be anticipated.

By way of example and without limitation, satisfactory coatings have been obtained on steel roller cores of from one half to two inch diameter, engraved with a 65 count per lineal inch pyramidal cell configuration, utilizing a transverse speed of nozzle relative to core of 0.1 to 1½ inch per revolution of the roller, the periphery of which is spaced from the nozzle a distance of from about 2 to 4 inches.

The molten spray is propelled from the nozzle of the gun at a temperature in the range of from 18000° to 30000° F, and the temperature being adjusted in accordance with the composition of the powder used and the rate at which it is fed, and the spacing of nozzle from core.

Figure 4:
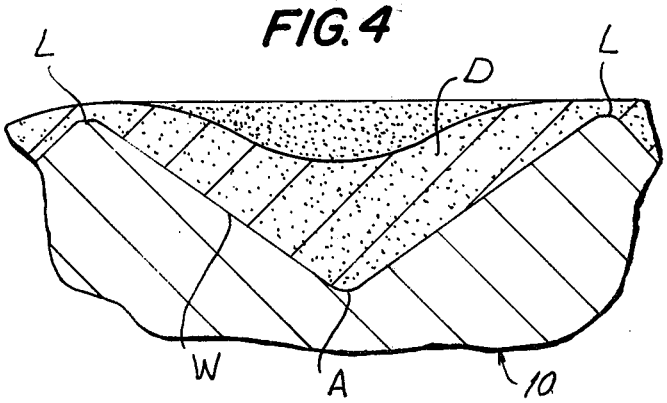
FIG. 4 is a section similar to FIG. 3, illustrating in diagrammatic manner the appearance of the cell after coating.

In the case of a typical aluminum oxide $Al_2O_3$ compound, satisfactory results have been achieved utilizing nozzle temperatures of approximately 22000° F, + or − 2000°, the velocity of the molten powder being from about Mach 1 to Mach 2 with a nozzle spacing of 3½ inches. The molten material instantly and permanently fuses to the scanned surface, the coating build-up on the portions of the inclined walls W nearest the periphery being at a lesser rate than on those surfaces perpendicular to the discharge. In practice, by minimizing the dimension of lands L, maximum build-up is achieved centrally of the receiver cells 11. There is diagrammatically shown in FIG. 4 the configurations assumed by the accumulated ceramic material, the ceramic coating layer being designated D.

In a typical example, and without limitation, each receiver cell has a depth at the apex of about 125 microns, and a volumetric capacity of about 6,770,000 cubic microns, the land dimensions being of the order of 15 microns. After coating, the average depth of the metering cells is about 45 microns, and the volume of such metering cells about 400,000 cubic microns.

An important additional advantage inhering in the roller lies in the highly predictable ink release characteristics. Specifically, it has been determined that by providing relatively shallow pyramidal receiver cells wherein the wall inclinations are disposed at 36° or less relative to the periphery of the roller, there are formed metering cells wherein a predictable percentage of the ink material supplied to each cell is released from the cell during each contact of the inked roller with the printing roller or other receiving surface. In contrast, traditional relatively steep angled metering cells of conventional anilox rollers may distribute more or less of the percentage of entrained liquid during each cycle, and are highly sensitive to the viscosity and surface tension characteristics of the inks used.

It is not altogether clear whether the desirable high-predictability release characteristic of the herein described roller is the result of the shallow angle of the cells or the physical nature of the ceramic coating, or a combination thereof. It is believed that the release property results from a synergistic interplay of composition and configuration since attempts to duplicate the release through the use of a ceramic coated flat roller of even and of irregular surface texture has failed to achieve the desired result, as has a roller embodying essentially similarly configurated cells but not having the ceramic coating.

In large measure, the configuration of cells in metallic (uncoated) rollers has been dictated by the high wear characteristics of such rollers, it being found necessary to provide relatively steep cell inclinations in order to minimize the effects of wear on the volumetric capacity of the cell.

An anilox roller having the characteristics hereinabove described permits the utilization of a relatively shallow cell configuration, with the attendant predictable release characteristics discovered to inhere therein.

From the above disclosure it will be understood that variations in many of the aspects of the method and article may be introduced without departing from the spirit of the invention. By way of example, although the invention has been illustrated and described in conjunction with a pyramidal cell configuration whose base is square in plan, it will be readily recognized that other configurations admitting of minimal land areas between adjacent cells may be advantageously employed, the term "pyramidal" being herein used broadly. The specific configuration illustrated has been found preferable to others in part by reason of the relative facility with which it can be formed, especially where the roller is to be used for the application of ink.

While the principal utility of the roller is presently considered to lie in the art of applying measured quantities of ink from an ink source to an imprinting roller or mechanism, and especially the imprinting roller of an apparatus for rough and high volume printing, e.g. the printing of corrugated board, boxes, etc., the apparatus has utility in a variety of other arts, including glue applicator rolls, rotogravure coating rollers and the like, and the claims are to be construed accordingly.

Having thus described the invention and illustrated its use, what is claimed as new and is desired to be secured by Letters Patent is:

1. As a new article of manufacture, a durable metering roll for the application of ink and like fluids having isolated peripheral metering cells of a predetermined volumetric capacity, comprising a cylindrical metal core, said core having formed in its periphery a multiplicity of substantially regularly spaced-apart receiver cells entirely surrounded by land portions defined by the periphery of said core, said receiver cells being of a first volume exceeding said predetermined volume, said receiver cells being in the general form of inverted pyramids having their base portions coincident with said periphery and including side walls inclined at an acute angle to the surface of said periphery, said angle not exceeding about 36°, and a continuous plasma spray ceramic coating covering said periphery and the exposed surface of said cells, the exposed surface of said coating defining outwardly directed metering cells the side walls of which are inclined with respect to said periphery at an angle substantially more acute than the comparable angle between said cylindrical surface and the walls of said receiver cells, the volume of said metering cells being about one fifth or less of the volume of said receiver cells.

2. An article in accordance with claim 1 wherein said receiver cells are separated by land areas at the periphery of said core, the extent of said land areas between adjacent receiver cells not exceeding about 30 microns, the extent of the land areas between metering cells being substantially greater than between receiver cells.

3. An article in accordance with claim 2 wherein said extent of said land areas between receiver cells is about 15 microns.

4. An article in accordance with claim 1 wherein the volumetric capacity of said metering cells is in the range of from about 1/12 to 1/20 of the volume of said receiver cells.

5. An article in accordance with claim 1 wherein the cell concentration of said roll is in the range from about 35 to 90 cells per lineal inch in either direction.

6. The method of making a ceramic coated metering roller having highly predictable ink release characteristics and including a periphery comprised of ceramic lined metering cells of pyramidal configuration comprising the steps of providing a cylindrical metal base core, forming in the periphery of said core a multiplicity of isolated, substantially evenly spaced, depressed pyramidal receiver cells, said cells being concentrated in the range of from about 35 to 90 cells per lineal inch in each direction, and being surrounded by land portions defined by the cylindrical surface of said core, the wall portions of said receiver cells being inclined at an acute angle with respect to said surface, said angle not exceeding about 36°, the volumetric capacity of said receiver cells being five or more times the desired volume of said metering cells, subjecting the periphery of said core having said pyramidal cells formed therein to a stream of molten ceramic particles contained in a gaseous stream directed normal to the axis of said core, thus to form on said cylindrical surface and the exposed surfaces of said receiver cells a durable ceramic coating, the thickness of the coating over said land areas being less than the thickness of the coating over said receiver cells, thereby to define said metering cells in registry with said receiver cells, said metering cells having a volumetric capacity of one fifth or less of said receiver cells.

7. The method in accordance with claim 6 wherein the receiver cells are formed with minimal land areas not exceeding about 30 microns separating said cells, said coating being applied to achieve a desired and substantially greater separation of said metering cells than the separation of said receiver cells.

* * * * *